US010017191B2

(12) United States Patent
Single

(10) Patent No.: US 10,017,191 B2
(45) Date of Patent: Jul. 10, 2018

(54) GONDOLA CAR CLEAN-OUT DOOR

(71) Applicant: JAC Operations, Inc., Chicago, IL (US)

(72) Inventor: Dave Single, Portage, PA (US)

(73) Assignee: JAC OPERATIONS, INC., Chicago ( * ) Notice: Subject to any disclaimer, the term of this patent is extended or adjusted under 35 U.S.C. 154(b) by 93 days.

(21) Appl. No.: 15/289,466

(22) Filed: Oct. 10, 2016

(65) Prior Publication Data

US 2017/0129504 A1 May 11, 2017

Related U.S. Application Data

(63) Continuation-in-part of application No. PCT/US2015/025475, filed on Apr. 10, 2015.

(60) Provisional application No. 61/977,753, filed on Apr. 10, 2014.

(51) Int. Cl.

| | |
|---|---|
| ***B61D 3/00*** | (2006.01) |
| ***B61D 7/18*** | (2006.01) |
| ***B61D 7/22*** | (2006.01) |

(52) U.S. Cl.

CPC ..... *B61D 7/18* (2013.01); *B61D 7/22* (2013.01)

(58) Field of Classification Search

CPC .. B61D 3/00–3/10; B61D 17/00–17/10; B61D 7/18; B61D 7/22

See application file for complete search history.

(56) References Cited

U.S. PATENT DOCUMENTS

| | | | | |
|---|---|---|---|---|
| 2,681,470 | A | 6/1954 | Johnson | |
| 2,722,899 | A | 11/1955 | Brown | |
| 4,212,252 | A | 7/1980 | Hart et al. | |
| 4,361,097 | A | 11/1982 | Jones et al. | |
| 4,911,082 | A | 3/1990 | Richmond | |
| 5,253,593 | A | 10/1993 | Kurtz et al. | |
| 5,335,603 | A * | 8/1994 | Wirick | B61D 7/02 105/406.1 |
| 5,488,912 | A * | 2/1996 | Pileggi | B61D 17/04 105/422 |
| 5,813,353 | A * | 9/1998 | Sauter | B61F 1/02 105/406.1 |

(Continued)

FOREIGN PATENT DOCUMENTS

| | | |
|---|---|---|
| RU | 2271292 | 3/2006 |
| WO | 2015157734 | 10/2015 |

*Primary Examiner* — Jason C Smith

(74) *Attorney, Agent, or Firm* — Blynn L. Shideler; Krisanne Shideler; BLK Law Group

(57) ABSTRACT

A gondola railcar cleanout door is configured to be coupled to a side plate of a railcar adjacent a railcar floor wherein the side plate and floor each have an opening therein. The cleanout door includes a frame mountable to the railcar side plate structure, adjacent the side plate structure opening; and a door assembly coupled to the frame and moveable between an open position in which the openings in the floor and the side plate may be used to clean out the interior of the railcar, and a closed position substantially closing the openings in the side plate and the floor, wherein the door assembly includes a door side wall member configured to substantially close the opening in the side plate in the closed position and a door floor member configured to substantially close the opening in the floor in the closed position.

20 Claims, 5 Drawing Sheets

(56) References Cited

U.S. PATENT DOCUMENTS

| | | | | |
|---|---|---|---|---|
| 6,148,735 | A * | 11/2000 | Sauter | B61D 7/00 105/199.3 |
| 6,978,720 | B2 * | 12/2005 | Johnson | B61D 17/08 105/380 |
| 7,434,519 | B2 * | 10/2008 | Forbes | B61D 17/00 105/406.1 |
| 7,461,600 | B2 * | 12/2008 | Forbes | B61D 17/00 105/244 |
| 7,559,284 | B2 | 4/2009 | Forbes et al. | |
| 7,757,611 | B2 | 7/2010 | Forbes et al. | |
| 7,878,125 | B2 | 2/2011 | Forbes et al. | |
| 8,025,014 | B2 | 9/2011 | Forbes et al. | |
| 8,132,515 | B2 * | 3/2012 | Forbes | B61D 7/02 105/240 |
| 8,240,256 | B2 * | 8/2012 | Nutt | B61D 17/00 105/239 |
| 2017/0129504 | A1 * | 5/2017 | Single | B61D 7/18 |

* cited by examiner

GONDOLA CAR CLEAN-OUT DOOR

RELATED APPLICATIONS

This application is a continuation in part of international patent application PCT/US15/25475 filed Apr. 10, 2015 and which claims priority to U.S. patent application Ser. No. 61/977,753 filed Apr. 10, 2014, entitled "Gondola Car Clean-Out Door" which applications are incorporated herein by reference in their entirety. International patent application PCT/US15/25475 published Oct. 15, 2015 as WO 2015-157,734 which publication is incorporated herein by reference.

BACKGROUND INFORMATION

1. Field of the Invention

The present invention relates to a railcar cleanout door, particularly a gondola railcar cleanout door.

2. Background Information

In the railroad art, rolling stock comprises all vehicles that move on a railway. A gondola railcar, or simply gondola, is an open-top type of rolling stock used for carrying loose bulk materials. One explanation for the seemingly oddly named railcar is that prior to the proliferation of rail transport in America a significant amount of coal was shipped via flat boats that were termed "gondolas," generally in satirical reference to the famous Venetian rowing boats.

With the advancement of rail transport, the railroad cars first employed in the haulage of coal were thus named after these shallow-draft "gondola" boats and called "gondola cars". In the second half of the 20th century, coal haulage shifted from open hopper cars to high-sided gondolas. Using a gondola, the railroads are able to haul a larger amount of coal per car. Examples of gondola cars are illustrated in U.S. Pat. Nos. 4,212,252; 4,361,097; 4,911,082; 5,253,593; 5,335,603; 5,488,912; 5,813,353; 6,148,735; 6,978,720; 8,132,515; 8,240,256, which patents are incorporated herein by reference establishing the general nature of the relevant art.

It is common for aggregate gondola cars to have multiple clean-out doors, also called access doors, built into the side structure for removing small amounts of residual material from the car and/or to wash out the railcar interior. The clean out/wash out can be particularly important if the car is changing from hauling one type of lading to another. Car maintenance is another reason for requiring a thorough removal of residual lading. Typically the cleanout doors are simply hatches or doors that close against the floor of the gondola railcar, examples of which can be seen in U.S. Pat. Nos. 2,681,470; 2,722,899; 7,434,519; 7,461,600; 7,559,284; 7,757,611; 7,878,125, and 8,025,014 which patents are also incorporated herein by reference. Russian Patent 2271292 discloses a hatch formed on the rounded gondola tub of a railcar.

Some of these prior art gondola railcar cleanout door constructions fail to provide sufficient access to the railcar interior, while others prove structure that is difficult to open or provides a structure that is insufficiently robust to withstand the harsh working environment and/or lifespan of components expected for gondola railcars.

It is an object of the present invention to address these deficiencies of the existing prior art and provide a cost effective cleanout door structure that simultaneously provides sufficient access to the railcar interior, and that is easy to open and that is sufficiently robust to withstand the working environment and long lifespan of components expected for gondola railcars.

SUMMARY OF THE INVENTION

This invention is directed to a cost effective, efficient, gondola railcar cleanout door that overcomes at least some of the drawbacks of the existing designs.

One aspect of the present invention provides a gondola railcar cleanout door is configured to be coupled to a side plate of a gondola car adjacent a floor of the gondola car wherein the side plate has an opening therein and the floor has an opening therein. The gondola railcar cleanout door includes a frame mountable to the side plate structure of the gondola railcar, adjacent the opening in the side plate structure; and a door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position.

One aspect of the present invention provides a gondola railcar comprising a railcar body including a side plate and a floor, wherein the side plate has at least one opening therein and the floor has at least one opening therein and one side plate opening and one floor opening combine to form at least one clean out opening for the railcar; and at least one cleanout door configured to be coupled to the side plate of a gondola railcar body adjacent the floor of the gondola car at each clean out opening, wherein the gondola railcar cleanout door includes: i) a frame mountable to the side plate structure of the gondola railcar, adjacent the opening in the side plate structure; and ii) a door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position.

One aspect of the present invention provides a method of retrofitting a gondola railcar with at least one clean out opening comprising the steps of: A) providing one opening in the sidewall and an associated opening in the floor for each clean out opening, wherein the side plate opening and floor opening combine to form the clean out opening for the railcar; and B) coupling one cleanout door to the side plate of a gondola railcar body adjacent the floor of the gondola car at each clean out opening, wherein the gondola railcar cleanout door includes: i) a frame mountable to the side plate structure of the gondola railcar, adjacent the opening in the side plate structure; and ii) a door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position.

These and other aspects of the present invention will be clarified in the description of the preferred embodiment of the present invention described below in connection with the attached figures in which like reference numerals represent like elements throughout.

BRIEF DESCRIPTION OF THE PREFERRED EMBODIMENTS

This invention is directed to a cost effective, efficient, gondola railcar cleanout door 10 that overcomes at least some of the drawbacks of the existing door designs. The gondola cleanout door 10 of the present invention as described herein provides a cleanout door structure that simultaneously provides sufficient access to the railcar interior, and that is easy to open and that is sufficiently robust to withstand the working environment and long lifespan of components expected for gondola railcars.

Figure 1:
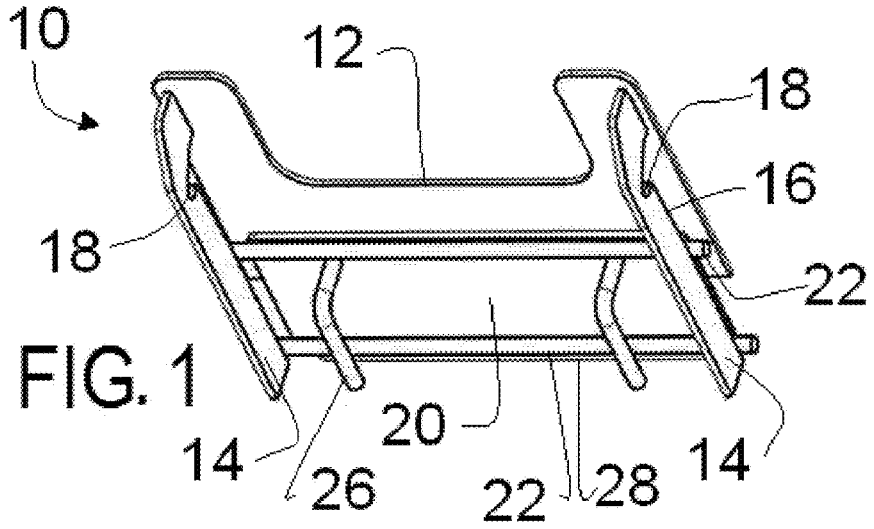
FIG. 1 is a perspective schematic view of a Gondola Railcar Cleanout Door according to one embodiment of the present invention.
Figure 2:
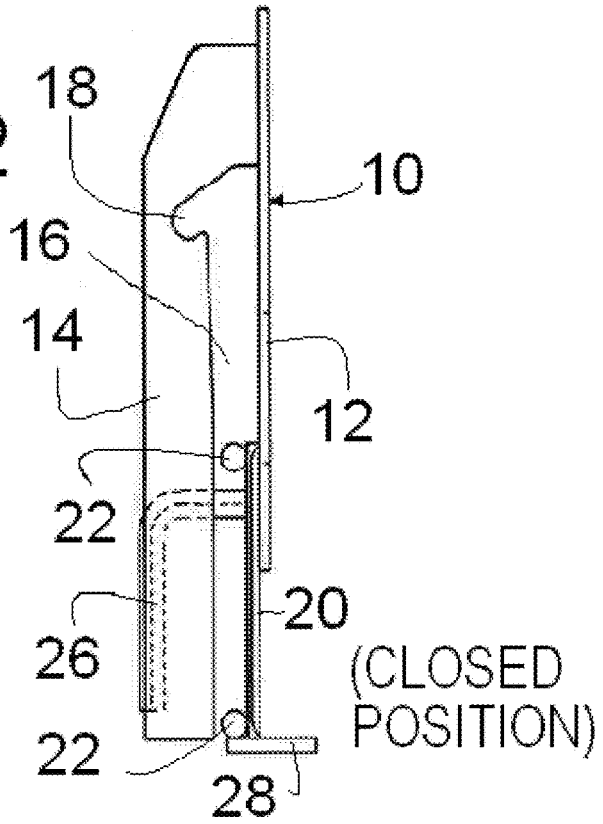
FIG. 2 is a end view of the Gondola Railcar Cleanout Door according to FIG. 1.
Figure 3:
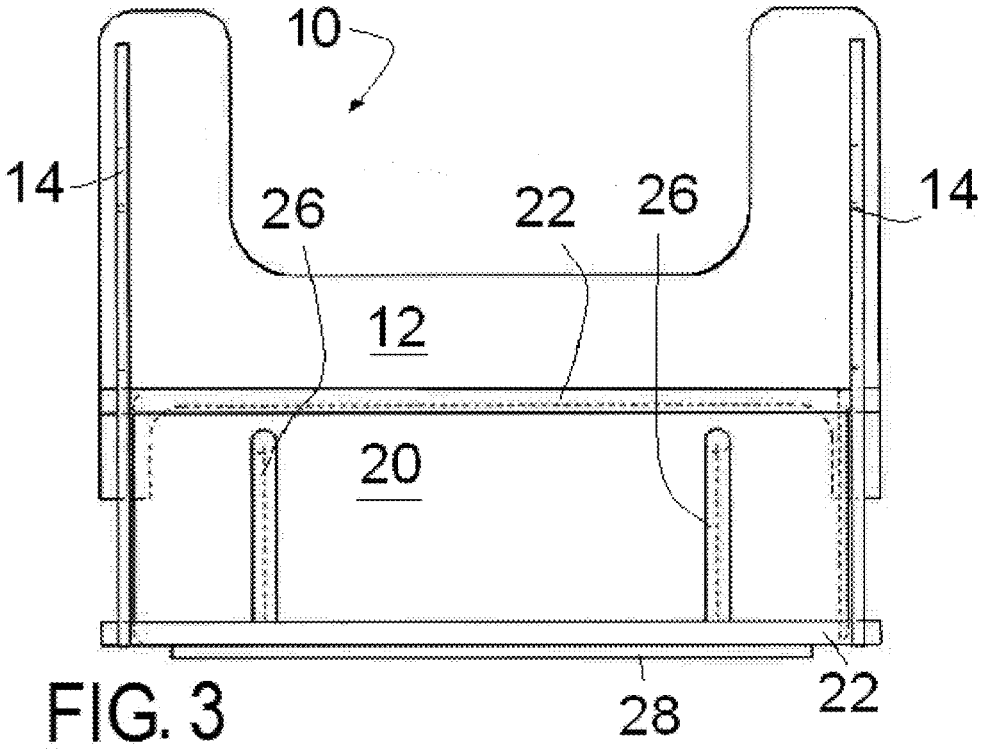
FIG. 3 is a side elevation view of the Gondola Railcar Cleanout Door according to FIG. 1.
Figure 4:
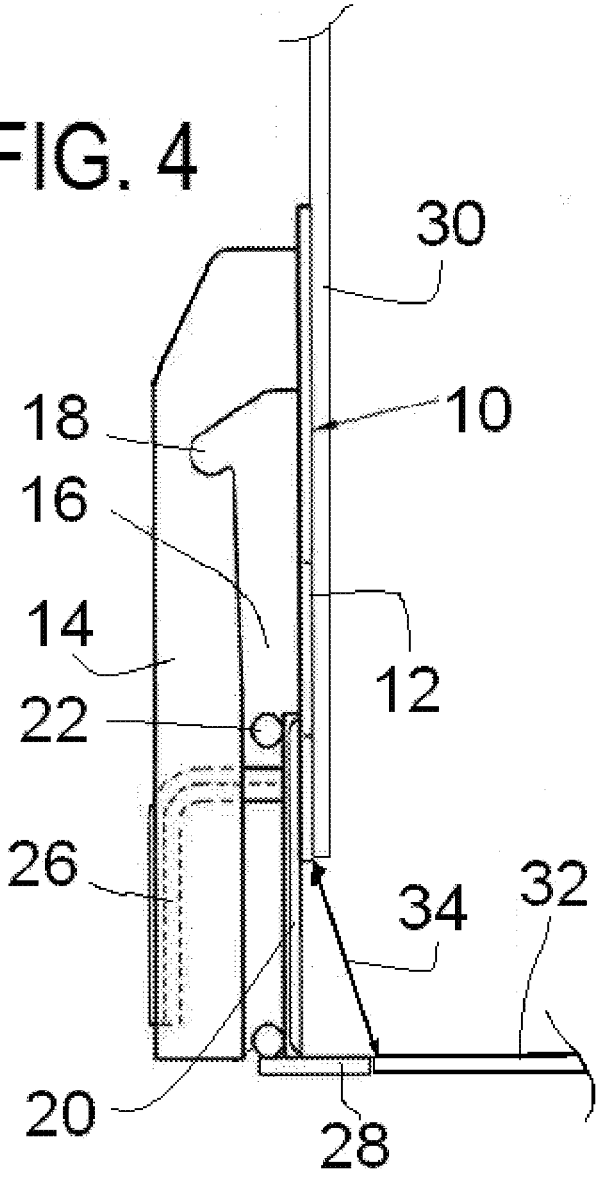
FIG. 4 is schematic end view of the Gondola Railcar Cleanout Door according to FIG. 1 on a gondola car shown partially in section.

One embodiment of the present invention is shown in FIGS. 1-4 and provides a gondola railcar comprising a railcar body including a side plate 30 (also called a side wall), shown schematically in FIG. 4, and a floor 32. As shown the side plate 30 has at least one opening therein and the floor 32 has at least one opening therein and the side plate opening and the floor opening combine to form a clean out opening 34 for the gondola railcar.

The details of the construction of the gondola railcar and railcar body are well known in the art as represented in the above cited patents which are incorporated herein by reference. Additional reference is made to gondola car construction provided by the assignee of the present invention who, directly and through predecessors, has been building aluminum, steel, and stainless steel coal cars for over a century.

The present invention provides one cleanout door 10 configured to be coupled to the side plate 30 of a gondola railcar body adjacent the floor 32 of the gondola car at each clean out opening 34.

The gondola railcar cleanout door 10 includes a frame 12 mountable to the side plate 30 structure of the gondola railcar, adjacent the opening in the side plate 30 that is forming part of the clean out opening 34. The frame 12 may be coupled to the side plate 30 with fasteners or welding or other conventional fastening methods.

The clean out door 10 includes a door assembly coupled to the frame 12, as discussed below. The door assembly is moveable between an open position in which the clean out opening 34, formed by the combination of the opening in the floor 32 and the opening in the side plate 30, may be used to clean out the interior of the gondola rail car, and a closed position substantially closing the clean out opening 34 by closing both the opening in the side plate 30 and the opening in the floor 32.

The frame 12 includes a pair of rail members 14 extending generally vertically and configured to guide the door assembly for movement between the open and closed position. A slot 16 extends in each rail member 14 for guiding the door assembly for movement between the open and closed position. Each rail member further includes a notch 18 configured to support the door assembly in the open position.

The door assembly includes a door side wall member 20 configured to substantially close the opening in the side plate 30 with the door assembly in the closed position. The door assembly includes a pair of spaced bars 22 coupled to the door side wall member 20 and the bars 22 are received in each rail member slot 16 guiding the door assembly for movement between the open and closed position.

The upper bar 22 may be positioned in the notch 18 with the door assembly in the open position to support the door assembly in the open position. The door assembly includes a pair of handle members 26 coupled to the door assembly to allow easy manual movement of the door assembly. The guide bars 22 and handle members 26 may be welded to the door side wall member 20.

The door assembly includes a door floor member 28 configured to substantially close the opening in the floor 30 with the door assembly in the closed position. The door floor member 28 may be welded to the door side wall member 20. The gondola railcar cleanout door 10 preferably provides that the door floor member 28 is substantially aligned with the floor 32 when the door assembly is in the closed position as shown in FIG. 4.

The gondola railcar cleanout door 10 according to embodiment shown provides that the door floor member 28 extends inwardly of the door side wall member 20 toward the interior of the railcar. Further as shown, the door side wall member 20 is substantially parallel with the side plate 30.

Figure 5A:
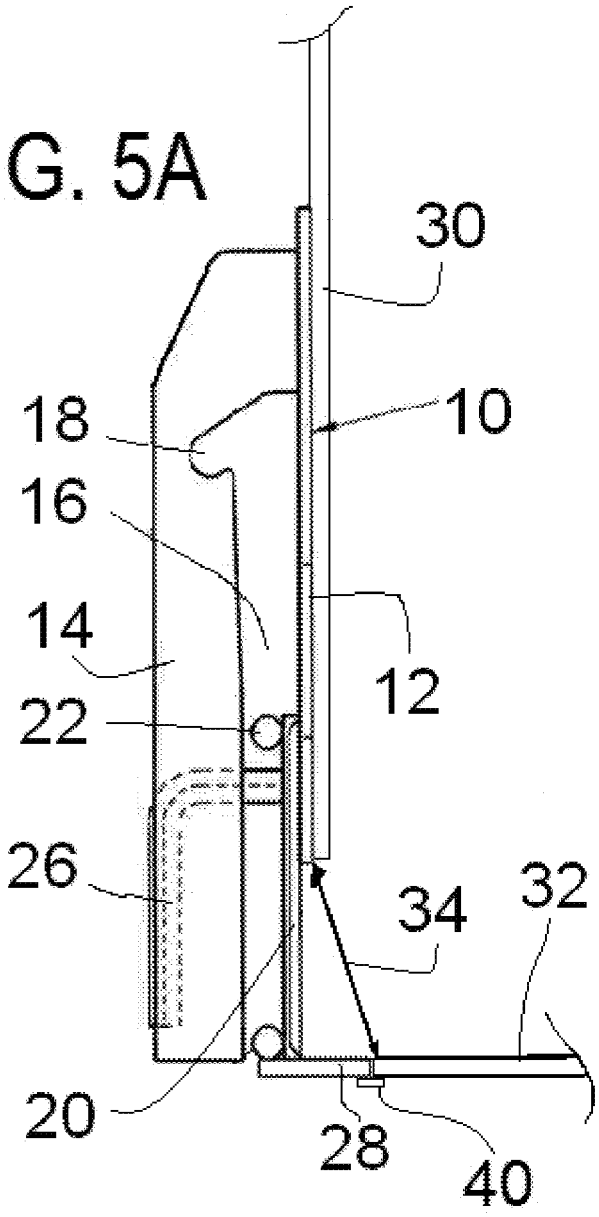
FIG. 5A is schematic end view of the Gondola Railcar Cleanout Door according to FIG. 1 on a gondola car shown partially in section, with an added floor sealing member.
Figure 5B:
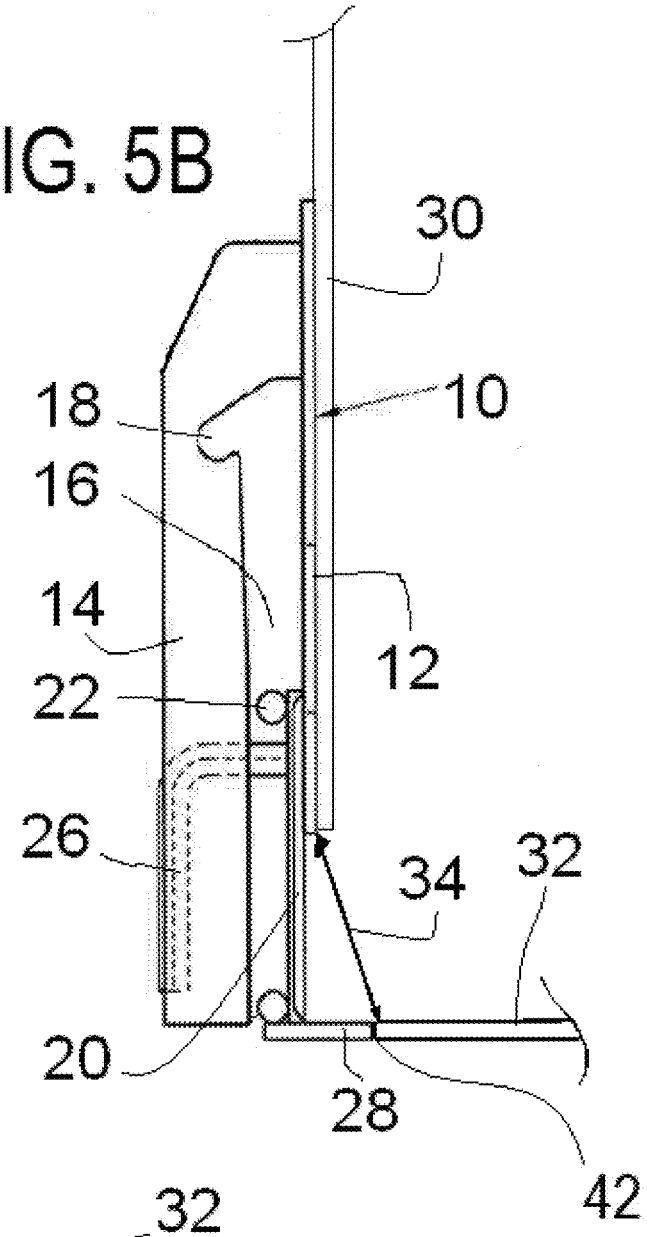
FIG. 5B is schematic end view of the Gondola Railcar Cleanout Door according to FIG. 1 on a gondola car shown partially in section, with an added floor sealing member.
Figure 5C:
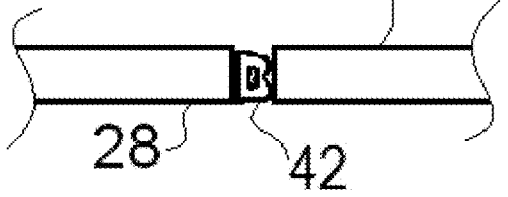
FIG. 5C is an enlarged schematic end view of the floor sealing member of FIG. 5B.

The size of the opening 34 can be altered easily via altering the size of the opening in the floor 32 and providing an appropriately sized door floor member 28. Additionally the door floor member 28 may be provided with a drain hole for allowing liquid to seep out of the lading. As shown in FIG. 5A-C, sealing members (e.g. rubber gasket 42) can be provided around the edge of the door floor member 28 and the inward face of the door side wall member 20 to provide a tight seal in the closed position.

FIG. 5A is schematic end view of gondola railcar cleanout door 10 according to FIG. 4 on a gondola car shown partially in section, with the door floor member 28 substantially aligned with the floor 32 when the door 10 is in the closed position. This embodiment further adds a floor sealing member in the form of a closing strip 40 that overlays the connection between the door floor member 28 and the floor 32. The strip 40 is tack welded to one of the door floor member 28 or the floor 32. If a gap is formed between the door floor member 28 substantially aligned with the floor 32 in the closed position the strip 40 will prevent the loss of lading. The strip may be a thin piece of metal as it is not acting as a floor member as it does not primarily support any lading (only the lading that might fit between a gap between the closed door floor member 28 and the floor 32. The strip 40 extends across the meeting of the closed door floor member 28 and the floor 32 only a distance sufficient for welding to one or the other structure. Further, even if on the floor 32, the strip 40 will not interfere with, or limit the size of, the opening 34. Alternatively, as shown in FIG. 5B, the gondola railcar cleanout door according to another embodiment of the invention may include an added floor sealing member; in the form of a rubber gasket 42. FIG. 5C is an enlarged schematic end view of the rubber gasket 42 floor sealing member of FIG. 5B. The gasket 42 fills a gap between the closed door floor member 28 and the floor 32, as shown, and may be attached via adhesive or the like, to either the closed door floor member 28 or the floor 32. The gasket 42 is preferably below the top surface of the closed door floor member 28 and the floor 32, as shown. The rubber gasket is preferably formed of a durable material such as Neoprene or polychloroprene which is a family of synthetic rubbers that are produced by polymerization of chloroprene and which exhibits good chemical stability and maintains flexibility over a wide temperature range. The illustrated gasket 42 is shown in an enlarged relatively exaggerated fashion merely for clarification of its placement and purpose as a relatively tight fit between the closed door floor member 28 and the floor 32 can be obtained and a narrow single layer gasket 42 is more than sufficient. The attaching of the gasket 42 to the door floor member 28 keeps the gasket 42 out of the way when using the clean out opening 34, however the attaching of the gasket 42 to the floor 32 can provide some protection to tools or operator arms extending through the opening 34 without limiting opening 34.

If desired a latching mechanism (and locking) may be provided to keep the door assembly in the closed position and to avoid tampering. However even without such additions, the formation of the door assembly will serve to maintain the door assembly properly closed when lading is present as the weight of the lading on the door floor 28 will act to hold it closed.

The provision of a latch or locking mechanism better accommodates a redesign of the opening and closing that may minimize the size of the frame. Namely elimination of the interference with the lower end of the guide members 14 and the lower guide bar 22 and a pivoting movement to the open position for the door is easily accommodated with a latch, as the latch will act to assist in holding the door 10 in the closed position. In one such alternative arrangement the slot 16 is only sized to allow the door floor 28 to be raised far enough to pivot outwardly, with the guide member 14 shortened to provide clearance for the lower guide bar 22 which is then pivoted to an open position above the upper guide bar 22 inverting the door side wall member. A receiving notch (not shown) in the upper part of the frame can be added to hold the inverted lower guide bar 22, while the original upper guide bar 22 is in the notch 18. The pivoting arrangement, not shown, is noted as an alternative but the sliding arrangement shown is preferred as simpler and easier manipulation because the handles 26 remain in an ergonomic position throughout the movement.

The formation of the cleanout opening 34 in the side wall structure (plate 30) and the floor 32 allows for a greater access of tools into the interior than is provided with similer sized wall only openings. The formation of the cleanout opening 34 as shown also provides increased visibility for inspecting the cleanout operation than with prior clean out opening construction, all without substantially increasing the size. The height of the cleanout opening will typically be less than 6" along the side plate 30.

The present invention is also easily retrofitted to existing gondola railcars, both those that have existing clean out doors and those that do not. The method of retrofitting a gondola railcar with at least one clean out opening 34 comprises the steps of: providing one opening in the sidewall and an associated opening in the floor for each clean out opening 34, wherein the side plate opening and floor opening combine to form the clean out opening 34 for the railcar. For railcars having a cleanout opening in the side this step is merely forming the floor opening. The second step is coupling one cleanout door 10 to the side plate 30 of a gondola railcar body adjacent the floor 32 of the gondola car at each clean out opening.

It is apparent that many variations to the present invention may be made without departing from the spirit and scope of the invention. The present invention is defined by the appended claims and equivalents thereto.

What is claimed is:

1. A gondola railcar cleanout door configured to be coupled to a side plate of a gondola car adjacent a floor of the gondola car wherein the side plate has an opening therein and the floor has an opening therein, wherein the gondola railcar cleanout door comprises:

A) A frame mountable to the side plate structure of the gondola railcar, adjacent the opening in the side plate structure;

B) A door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position, wherein the frame includes a pair of rail members configured to guide the door assembly for movement between the open and closed position.

2. The gondola railcar cleanout door according to claim 1 further including a sealing member provided around the edge of the door floor member.

3. The gondola railcar cleanout door according to claim 1 further including a slot extending in each rail member and wherein the door assembly includes at least one bar coupled to the door side wall member and received in each rail member slot.

4. The gondola railcar cleanout door according to claim 3 wherein each rail member includes a notch configured to receive at least one bar and support the door assembly in the open position.

5. The gondola railcar cleanout door according to claim 3 wherein two spaced bars are coupled to the door side wall member.

6. The gondola railcar cleanout door according to claim 3 further including at least one handle member coupled to the door assembly.

7. The gondola railcar cleanout door according to claim 3 wherein the door floor member is substantially aligned with the floor when the door is in the closed position.

8. The gondola railcar cleanout door according to claim 3 wherein the door side wall member is substantially parallel with the side plate.

9. The gondola railcar cleanout door according to claim 3 wherein the door floor member extends inwardly of the door side wall member toward the interior of the railcar.

10. A gondola railcar comprising

A) A railcar body including a side plate and a floor, wherein the side plate has at least one opening therein and the floor has at least one opening therein and one side plate opening and one floor opening combine to form at least one clean out opening for the railcar; and B) At least one cleanout door configured to be coupled to the side plate of a gondola railcar body adjacent the floor of the gondola car at each clean out opening, wherein the gondola railcar cleanout door includes:

i. A frame mountable to the side plate structure of the gondola railcar, adjacent the opening in the side plate structure; and ii. a door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position, wherein the frame of each clean out door includes a pair of rail members configured to guide the door assembly for movement between the open and closed position.

11. The gondola railcar according to claim 10 further including a sealing member provided around the edge of the door floor member.

12. The gondola railcar according to claim 10 wherein each clean out door further includes a slot extending in each rail member and wherein the door assembly includes at least one bar coupled to the door side wall member and received in each rail member slot.

13. The gondola railcar according to claim 12 wherein each rail member of each clean out door includes a notch configured to receive at least one bar and support the door assembly in the open position.

14. The gondola railcar according to claim 12 wherein each clean out door includes two spaced bars coupled to the door side wall member.

15. The gondola railcar according to claim 12 wherein each clean out door further includes at least one handle member coupled to the door assembly.

16. The gondola railcar according to claim 12 wherein each clean out door is configured wherein the door floor member is substantially aligned with the floor when the door assembly is in the closed position.

17. The gondola railcar according to claim 12 wherein the door side wall member of each clean out door is substantially parallel with the side plate.

18. The gondola railcar according to claim 12 wherein the door floor member of each clean out door extends inwardly of the door side wall member toward the interior of the railcar.

19. A method of retrofitting a gondola railcar with at least one clean out opening comprising the steps of:

providing one opening in the sidewall and an associated opening in the floor for each clean out opening, wherein the side plate opening and floor opening combine to form the clean out opening for the railcar; and coupling one cleanout door to the side plate of a gondola railcar body adjacent the floor of the gondola car at each clean out opening, wherein the gondola railcar cleanout door includes:

i. A frame mountable to the side plate structure of the gondola railcar, adjacent the opening in the side plate structure; and ii. a door assembly coupled to the frame and moveable between an open position in which the opening in the floor and the opening in the side plate may be used to clean out the interior of the gondola rail car, and a closed position substantially closing the opening in the side plate and the opening in the floor, wherein the door assembly includes a door side wall member configured to substantially close the opening in the side plate in the closed position and a door floor member configured to substantially close the opening in the floor in the closed position, wherein the door floor member of each clean out door extends inwardly of the door side wall member toward the interior of the railcar.

20. The method according to claim 19 further including a sealing member provided around the edge of the door floor member of each clean out door.

* * * * *